US008166989B2

(12) United States Patent
Heim

(10) Patent No.: US 8,166,989 B2
(45) Date of Patent: May 1, 2012

(54) NORDIC WALKING POLE WITH RUBBER BUFFER

(75) Inventor: Eberhard Heim, Unterensingen (DE)

(73) Assignee: Lekisport AG, Baar (CH)

( * ) Notice: Subject to any disclaimer, the term of this patent is extended or adjusted under 35 U.S.C. 154(b) by 220 days.

(21) Appl. No.: 12/374,597

(22) PCT Filed: Sep. 17, 2007

(86) PCT No.: PCT/CH2007/000451

§ 371 (c)(1),
(2), (4) Date: Jan. 21, 2009

(87) PCT Pub. No.: WO2008/037098

PCT Pub. Date: Apr. 3, 2008

(65) Prior Publication Data

US 2009/0314320 A1 Dec. 24, 2009

(30) Foreign Application Priority Data

Sep. 25, 2006 (CH) ..... 1521/06

(51) Int. Cl.
*A45B 9/04* (2006.01)

(52) U.S. Cl. ..... 135/78; 135/80; 135/81

(58) Field of Classification Search ..... 135/78, 135/80, 81

See application file for complete search history.

(56) References Cited

U.S. PATENT DOCUMENTS

| | | | | | |
|---|---|---|---|---|---|
| 39,854 | A | * | 9/1863 | Wemple | 135/68 |
| 415,511 | A | * | 11/1889 | Howgate | 135/81 |
| 483,118 | A | * | 9/1892 | Lamp | 135/81 |
| 619,235 | A | * | 2/1899 | Schwarting | 135/80 |
| 819,235 | A | * | 5/1906 | Schwarting | 215/317 |
| 1,298,721 | A | * | 4/1919 | Hughes | 135/81 |
| 2,480,382 | A | * | 8/1949 | Pagliuso | 248/188.5 |
| 2,492,916 | A | * | 12/1949 | Chute et al. | 135/80 |
| 2,606,568 | A | * | 8/1952 | Walcot et al. | 135/80 |
| 3,960,382 | A | * | 6/1976 | Reynolds | 280/823 |
| 4,411,284 | A | * | 10/1983 | Opitz | 135/81 |
| 4,977,914 | A | * | 12/1990 | Smerker | 135/81 |
| 5,353,825 | A | * | 10/1994 | Davis | 135/78 |

FOREIGN PATENT DOCUMENTS

| | | | |
|---|---|---|---|
| AT | 008 108 | U1 | 2/2006 |
| CH | 384 148 | A | 1/1965 |
| WO | 2005/120281 | A1 | 12/2005 |

* cited by examiner

*Primary Examiner* — Noah Chandler Hawk
(74) *Attorney, Agent, or Firm* — Sughrue Mion, PLLC

(57) ABSTRACT

A pole, in particular a Nordic walking pole, comprises a pole body (1), with a tip body (2) and a buffer (3) provided at its bottom end. The buffer (3) is displaceably mounted such that it can be arrested in an axial direction in relation to the pole body (1). The buffer (3) can be secured in at least two axially different positions in relation to the pole body (1) via a form-fitting connection.

22 Claims, 11 Drawing Sheets

Section "A-A"

Section "B-B"

Section "A-A"

Section "A-A"

Section "E-E"

NORDIC WALKING POLE WITH RUBBER BUFFER

CROSS REFERENCE TO RELATED APPLICATION

This application claims priority based on Switzerland Patent Application No. 01521/06, filed Sep. 25, 2006, the contents of all of which are incorporated herein by reference in their entirety.

TECHNICAL FIELD OF THE INVENTION

The present invention relates to a pole for use as a piece of sports equipment, in particular as a Nordic walking pole, according to the features of the preamble of claim 1.

PRIOR ART

The prior art discloses a large number of Nordic walking poles, not least since Nordic walking is highly popular with a wide section of the population.

WO 2005/120281 discloses such a Nordic walking pole which comprises a handle with a strap, a pole shaft, a pole tip and, in the region of the pole tip, a rubber buffer. The pole tip here can be displaced axially in the direction of the pole axis such that the tip extends out of the rolling surface of the rubber buffer or that the tip is fully retracted, in which case there are no parts of the tip extending beyond the rolling surface. For this purpose, the buffer is typically rotated by a certain angle about the pole axis, displaced axially and then rotated back again by the same angle. Accordingly, depending on the type of terrain, the user can select whether the pole is to be used with the rubber buffer or with the tip extended. When walking through woods or across fields with relatively coarse stones or gravel and a soft terrain, the user selects, for example, the extended tip. When walking on an asphalted road with a hard, usually more or less smooth surface, the user preferably selects the rubber buffer.

CH 384 148 discloses a protective device for pole tips. The protective device mentioned can be displaced axially along the pole axis and can be secured by an adjusting screw or a quick-acting clamping means. The protective sleeve here can assume different positions, namely, for example, a position in which the pole tip is released or one in which the pole tip is protected. The protective sleeve here is clamped in a force-fitting manner by means of a force which is applied radially to the circumference of the pole shaft by the adjusting screw or the quick-acting clamping means.

The disadvantage with the prior-art poles is generally the fact that changing over from using the tip to the rubber buffer or from using the rubber buffer to the tip is a rather complicated and laborious task.

A further disadvantage stems from the fact that, in the event of a relatively large force being applied in the axial direction, that is to say in the direction of the pole axis, many such rubber buffers could be displaced in the axial direction.

In addition, adjustable pole tips are susceptible to soiling. In particular on wet paths, dirt can accumulate between the pole tip and the pole shaft. Since only a small amount of play should be provided between the pole tip and pole shaft, the ingress of dirt can impede movement of the pole tip or even lead to such movement not being possible.

DESCRIPTION OF THE INVENTION

Taking this prior art as the departure point, it is an object of the invention to provide a pole, in particular a Nordic walking pole, of which the bottom region can be straightforwardly and reliably converted, so as not to be affected by soiling, from a situation in which a rubber buffer rests on the ground during use into a situation in which a tip rests on the ground, or vice versa, that is to say it is possible to change over from the tip to the rubber buffer.

This object is achieved by a pole having the features of patent claim 1. Advantageous configurations of the invention are specified in the dependent claims.

Accordingly, a pole, in particular a Nordic walking pole, comprises a pole body with a tip body and a buffer provided at its bottom end. The buffer is mounted such that it can be displaced and secured in an axial direction in relation to the pole body. The buffer can be secured in at least two axially different positions in relation to the pole body via a form-fitting connection. The tip body and/or the lowermost portion of the pole body are/is arranged to pass through a central axial opening in the buffer, and the buffer is mounted such that it can be displaced and secured in an axial direction in relation to the pole body in this central opening.

The buffer of such a pole can be moved particularly reliably and straightforwardly according to the object of the invention so as not to be affected by soiling.

The tip body preferably has a latching guide means. A latching body mounted in the buffer can engage in a form-fitting manner in this latching guide means in order to secure the axial position.

This allows a particularly good connection between the pole and buffer which is particularly resistant to the forces which arise when the pole is being used, in which case undesirable displacement is not possible.

The latching body can preferably be moved from a first position, in which the buffer is blocked in a form-fitting manner in respect of movement relative to the pole body, into a second position, in which the buffer can be displaced axially relative to the pole body.

Such a movement of the latching body makes it possible for the user of the pole to adjust the buffer particularly straightforwardly.

It has generally proven advantageous, precisely in the case of such complex and therefore costly designs of the buffer, if that region of the buffer which is subjected to wear, in other words both the hard tip and the rolling region, is or are configured in an exchangeable manner. A preferred embodiment is correspondingly distinguished by the provision, e.g. on the underside of the buffer, on the rolling surface of the latter, of an exchangeable region, in particular a profiled region (a profiled sole), which forms the rolling surface, wherein the region can be fitted on the top portion of the buffer via force-fitting and/or form-fitting connecting means.

BRIEF DESCRIPTION OF THE FIGURES

The invention will be described in more detail hereinbelow with the aid of the exemplary embodiments and with reference to the drawings, in which.

DESCRIPTION OF THE EXEMPLARY EMBODIMENTS

The invention as defined in the appended claims will be explained hereinbelow with the aid of the exemplary embodiments. It should be emphasized that the exemplary embodiments which will now be mentioned are to be understood exclusively as supporting and illustrating the subject matter defined in the appended claims and should not be used to interpret these claims in a restrictive manner.

Figure 1:
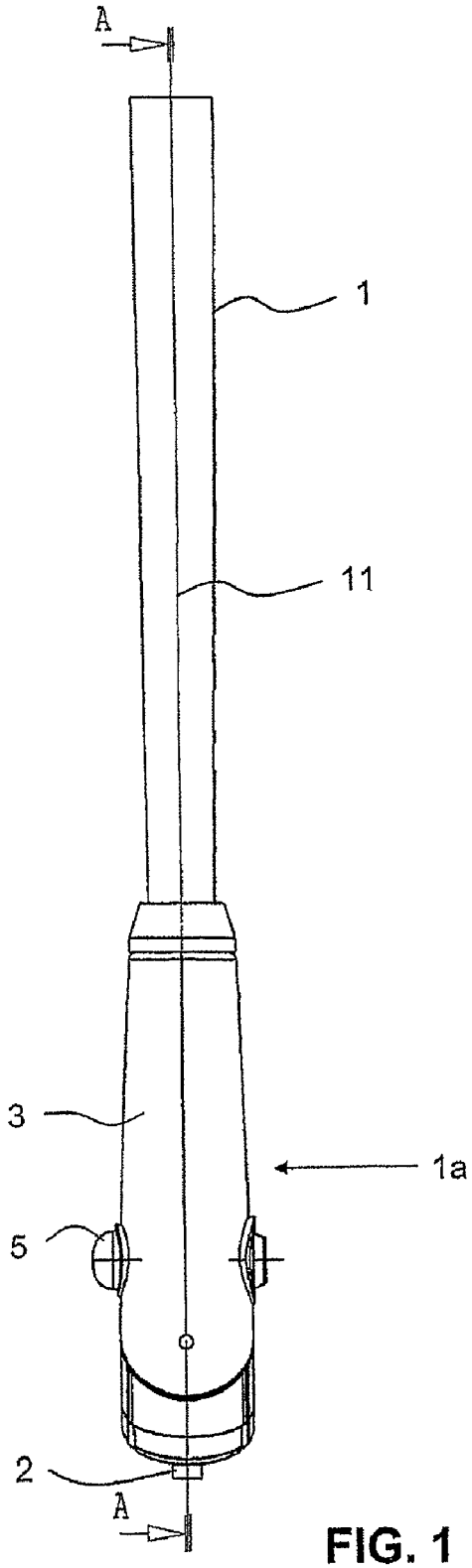
FIG. 1 shows a view of a first exemplary embodiment of a Nordic walking pole from the rear, with a buffer in a top position according to the present invention.
Figure 2:
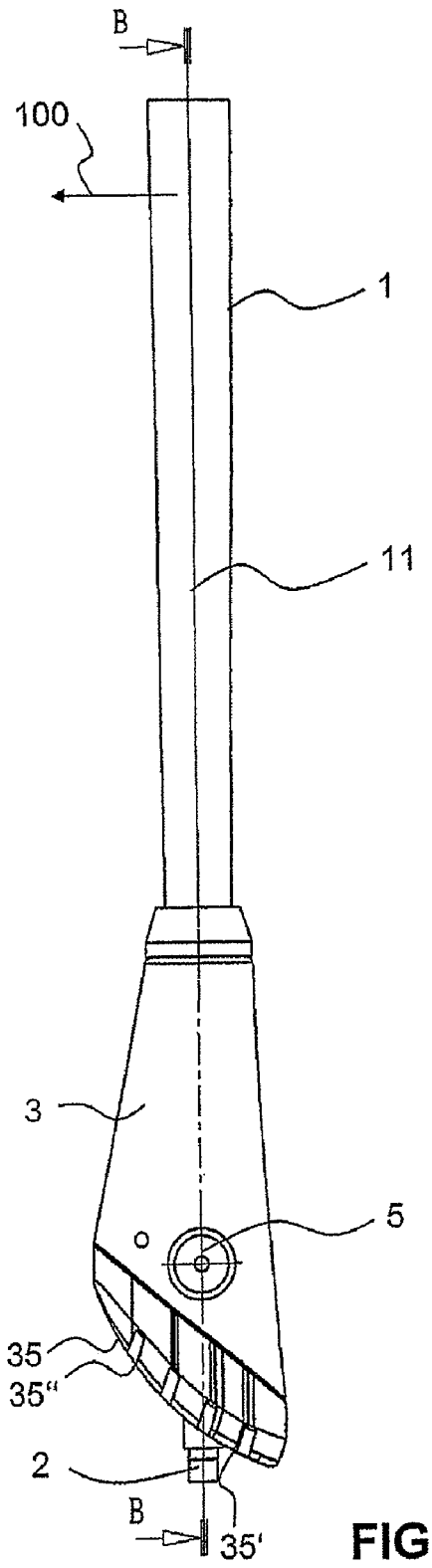
FIG. 2 shows a side view of a Nordic walking pole according to FIG. 1.

FIGS. 1 and 2 show a bottom part of a pole, in particular of a Nordic walking pole. The pole according to the invention comprises at least one pole body 1 with a center axis 11 and, in a bottom region 1*a*, also comprises a tip body 2 and a buffer 3. The pole body 1 here may constitute an entire pole or else a bottom part of a telescopic pole. The buffer 3, according to the present invention, can typically be moved from a top position, in which parts of the tip body 2 project beyond the buffer 3, into a bottom position, in which the tip body 2 is fully enclosed by the buffer 3. The buffer moves axially relative to the pole body 1. In addition, the buffer 3 can be blocked in a form-fitting manner in its top and its bottom positions by a latching means 5 which engages in a latching guide means arranged on the pole body 1 or on the tip body 2.

In addition, a handle with corresponding hand straps may be arranged in a top region (not shown).

The pole according to the invention is always used in the same direction of orientation by the user. This direction of orientation is designated by way of a direction of travel 100. A first plane extends in this direction of travel 100 and through the center axis 11. This first plane is congruent with the section plane A-A. A second plane passes likewise through the center axis 11 and is located perpendicularly to the direction of travel 100. Accordingly, the second plane is perpendicular to the first plane. This second plane is congruent with the section plane B-B.

Figure 3:
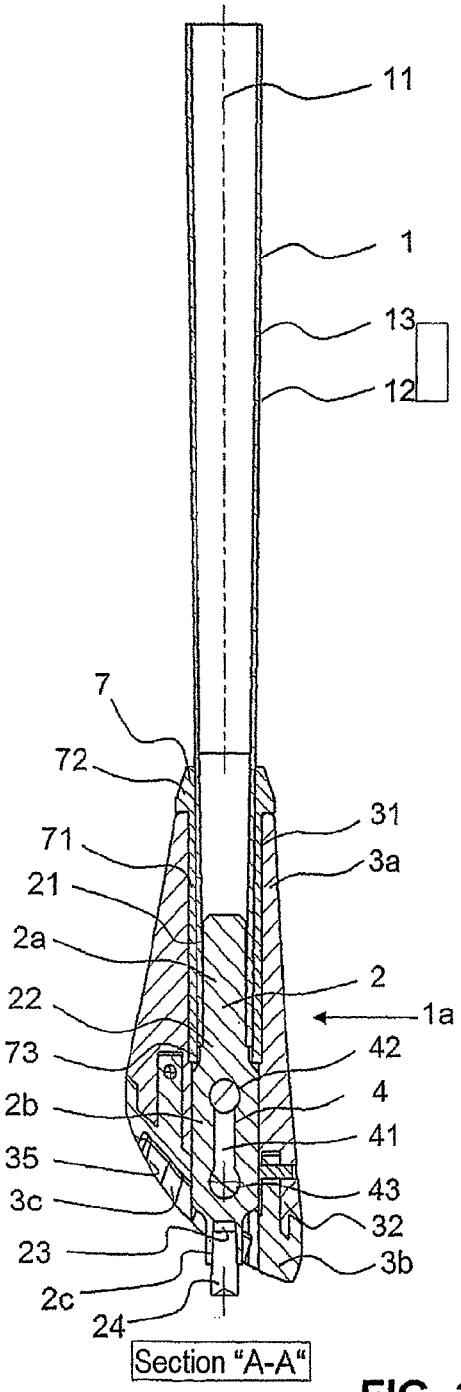
FIG. 3 shows a longitudinal section of a Nordic walking pole with a buffer in the top position, the section being taken along section line A-A according to FIG. 1.

FIG. 3 shows a sectional view of the first exemplary embodiment. The pole body 1 illustrated here is of tubular configuration, the external diameter decreasing toward the bottom portion la. The pole body 1 is thus configured conically in certain regions. As an alternative, however, it is also possible for the pole body 1 to have a constant external diameter. The tubular pole body 1 has an outer side 12 and an inner side 13. As an alternative, the pole body 1 may also consist of a solid material, in which case this pole body 1 does not have any inner sides 13.

The tip body 2 is preferably fixed to the pole body 1. The method of connection may vary. The tip body 2 is particularly preferably screwed and/or adhesively bonded into the pole body 1. A press connection is likewise conceivable. Provided the pole body 1 and the tip body 2 consist of a weldable material, they may also be welded to one another. This connection means that the tip body 2 cannot be displaced relative to the pole body 1.

The tip body preferably has a top portion 2*a*, a middle portion 2*b* and a bottom portion 2*c*.

The top portion 2*a* has a cylindrical external shape 21 and has a diameter which corresponds essentially to the diameter of the inner side 13 of the pole body 1. The external shape 21, however, may also comprise, for example, a thread, in which case the tip body 2 can be screwed into the pole body 1. In addition, the top portion 2*a* has a flange 22 which has a diameter which is larger than the diameter of the inner side 13. As a result of this flange 22, it is possible for forces to be better transmitted in the direction of the pole axis from the tip body 2 to the pole body 1. In addition, the flange 22 prevents the tip body 2 from possibly being displaced in the direction of the center axis 11 as a result of forces which arise from the pole being used.

The middle portion 2*b*, in this exemplary embodiment, has an essentially rectangular cross section. The latching guide means 4 is arranged in this portion 2*b* of the tip body 2. The latching guide means 4 serves for blocking the buffer 3 in a form-fitting manner in defined positions. In the present, first exemplary embodiment, the latching guide means 4 is in the form of a slot 41. The slot 41 runs parallel to the center axis of the tip body 2 or of the pole body 1, respectively, and has a widened portion 42, 43 at each of its ends, in this case a circular top widened portion 42 and a circular bottom widened portion 43. As seen in the direction of the center axis 11, the widened portions 42, 43 are wider than the slot, that is to say the diameter of the widened portions 42, 43 is larger than the width of the slot.

The tip body 2 has a cylindrical cross section in the bottom portion 2*c*. Cylindrical or rectangular or square cross sections are particularly preferred. In addition, the tip body 2 has a recess 23 (blind hole) extending in the direction of the center axis 11. The recess 23 serves for accommodating the tip 24. The tip 24 is connected to the tip body 2 via a press connection, adhesive-bonding connection, weld connection or screw connection.

The tip body 2 is preferably produced from aluminum or steel. The tip 21 is advantageously produced from a possibly coated metal or sintered material (preferably sintered hard metal) with a high level of hardness or from possibly coated ceramic material, such that the tip has the necessary robustness in relation to impact, wear and shocks which arise during use.

A sleeve 7 is arranged likewise in the bottom region 1*a* of the pole body 1. The sleeve 7 here encloses the pole body on its outer side 12. The sleeve 7 has a tubular portion 71. A top end of the sleeve has a flange 72. The bottom end, opposite the flange 72, is designated with reference numeral 73. The sleeve here is pushed onto the pole body 1 with the flange 72 in front. The sleeve 7 serves, in particular, as a sliding sleeve for the buffer 3. As is shown in FIG. 3, the bottom end 73 ends up located essentially in the region of the flange 22 of the tip body 2.

The buffer 3 comprises essentially a top portion 3*a*, a bottom portion 3*b* and a rolling portion 3*c* with a rolling surface 35. As can be seen in FIG. 1, the buffer 3 is designed to be essentially asymmetrical in the direction of the first plane. The buffer 3 is configured symmetrically in the second plane, that is to say essentially the rolling surface 35 is configured asymmetrically. The asymmetric configuration of the rolling surface 35 facilitates the dynamic movement of the user. Accordingly, it is very important for the buffer 3 to be oriented correctly in relation to the direction of travel 100. With the correct orientation, in the first instance a rear rolling point 35' comes into contact with the ground. Then the pole rolls along the rolling surface 35. When a point in the front rolling region 35" is reached, the user pushes the pole off the ground and the buffer 3 is no longer in contact with the ground. Accordingly, the rolling surface 35 is more or less in the cross-sectional shape of a circle segment in the direction of travel. This configuration renders the pole particularly comfortable for the user to use.

If the tip body 2 is projecting out of the buffer 3, typically only the tip body 2 comes into contact with the ground. In the case of soft ground, into which the tip can sink, the buffer 3 can assist movement.

Figure 4:
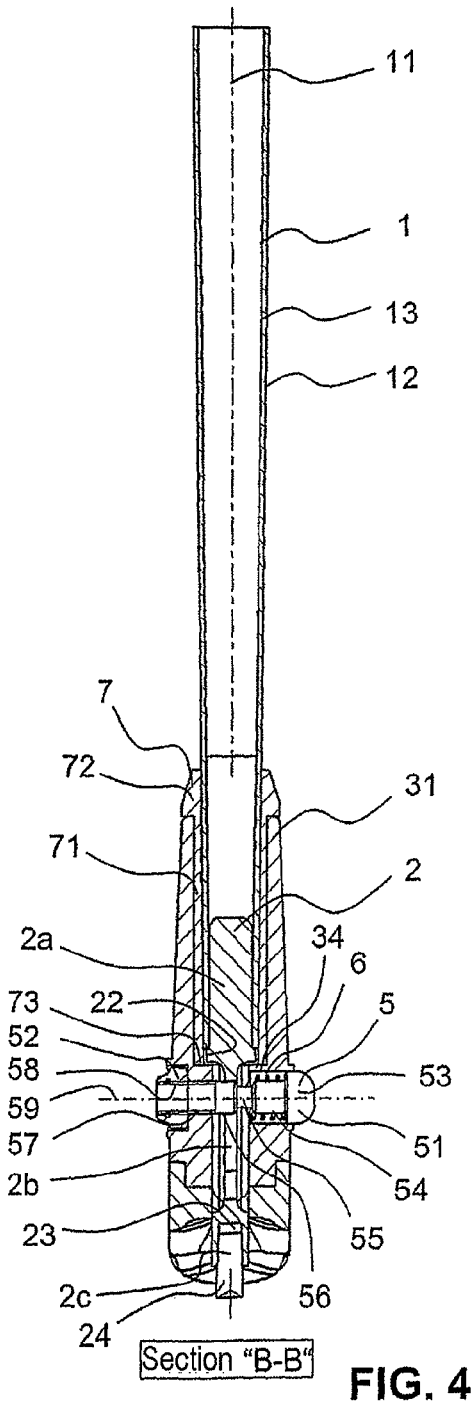
FIG. 4 shows a longitudinal section of a Nordic walking pole along section line B-B according to FIG. 2.

FIGS. 3 and 4 show the buffer in a sectional view, and the construction of the individual portions 3*a*-3*c* can be seen here.

In the top portion 3*a*, the buffer 3 has a cylindrical opening 31, of which the shape is adapted to the external shape 71 of the sleeve 7. In addition, the top portion 3*a* has accommodating openings 32, which can accommodate parts of the bottom portion 3*b* (which virtually is a profiled sole which is possibly exchangeable or can be structured in different ways or produced from a different material—e.g. with different frictional properties). In particular in the case of a comparatively complex and therefore costly tip design like the one proposed here, this exchangeability may be very advantageous in the event of wear. The bottom portion 3*b* may be configured in different ways here. For example, it is possible for the bottom portion 3*b* or the parts in the bottom portion 3*b*, respectively, to be provided with spikes. In other embodiments, the bottom portion 3*b* has a profiled rolling surface. A latching opening 34 which extends perpendicularly to the axis of the cylindrical opening 31 serves for accommodating the latching element 5. The latching opening 34 extends all the way through the buffer 3, and the latching opening 34 thus intersects the cylindrical opening 31. In the present exemplary embodiment, the latching opening 34 is located perpendicularly to the direction of travel 100. As an alternative, however, it is possible for the latching opening 34 to assume some other position in relation to the direction of travel 100. For example, the latching opening 34 may also be parallel to the direction of travel 100.

The bottom portion 3*b* serves as a connection between the rolling portion 3*c* and the first portion 3*a*. The first portion 3*a* preferably consists of a hard plastics material, e.g. PA, PP, POM; in this case good levels of strength and dimensional stability are relevant, but the friction, in contrast, is essentially irrelevant. That region of the profiled sole which rests on the ground, i.e. in any case the region 3*c* (3*b* may also consist of a hard material), is soft with good static friction in relation to the ground, and is therefore made, for example, of rubber, elastomer, silicone, TPE or TPU. If the buffer is not configured in two parts with a profiled sole, then its rolling surface may also have such a coating.

The buffer 3 can be pushed onto the sleeve 7, which is connected to the pole body 1, by way of its opening 31. The buffer can be displaced in the direction of the center axis 11, as will be described hereinbelow, between a top position and a bottom position. If the buffer 3 is located in the top position, then at least the tip 24 or parts of the tip body 2 projects/project beyond the rolling surface 35. If the buffer 3 is in the bottom position, the tip is fully enclosed by the buffer 3 and there are no parts of the tip projecting beyond the rolling surface 35. As an alternative, it is also possible for the buffer 3 to be fitted on the pole body 1 without a sleeve 7.

FIG. 4 shows the latching body 5, which serves to block the buffer 3 in its top and/or bottom position. The latching body 5 here penetrates through the top region 3*a* of the rubber buffer and the middle portion 2*b* of the tip body. The latching body 5 is mounted in a displaceable manner essentially in or on the buffer 3. The configuration of the latching body 5 and of the latching guide means 4 allows the buffer 3 to be moved to a limited extent in the direction of the center axis 11 when the latching body 5 is actuated. This means that the buffer 3 and the latching body 5 can be displaced with one another in the direction of the center axis 11.

In the present, first exemplary embodiment, the latching body is in the form of a latching bolt 5. The latching bolt 5 comprises a latching-bolt pin 51 and a latching-bolt disk 52 (e.g. securing nut, securing ring, latching disk or rivet).

The latching-bolt pin 51 is of essentially cylindrical configuration and has an actuating flange 53, a spring portion 54, a release portion 55, a securing portion 56 and a fastening portion 57. The actuating flange 53 preferably has a larger diameter than the other portions 54 to 57. The diameter of the release portion 55 is smaller than the diameter of the securing portion 56. The securing portion 56 may also be referred to as a partially or wholly encircling groove or channel. The diameters of the spring portion 54, of the securing portion 56 and of the fastening portion 57 are preferably equal. The diameter of the securing portion 56 is essentially equal to, or insignificantly smaller than, the diameter of the circular bottom widened portion 42 or top portion 43 of the latching guide means 4. The fastening portion 57 has, for example, a thread on its outer side.

The latching-bolt disk 52 is essentially a disk with a concentric opening 58 containing, for example, a thread. The latching-bolt disk 52 may also be configured as a nut, possibly with a cylindrical external shape (knurled nut is also possible). The latching-bolt disk 52 may be connected to the fastening portion 57 of the latching-bolt pin 51. In addition, the connection may be secured with an adhesive or a deformable plastic ring which is positioned in the opening 58. Other securing means are likewise conceivable.

The latching bolt 5 is arranged perpendicularly to the center axis 11 and perpendicularly to the direction of travel 100. In this exemplary embodiment, the center axis 59 of the latching bolt 5 intersects the center axis 11 of the pole body 1. The latching bolt 5 can assume essentially two positions, namely a position in which it blocks the buffer 3 and in which the buffer 3 is blocked in a form-fitting manner in respect of axial movement, and a position in which it releases the buffer 3 and in which the buffer 3 can be moved axially. The two positions will be referred to hereinbelow as the blocking position or release position, respectively.

A spring 6 is arranged, in the region of the spring portion 54, in the opening 34. The opening 34 has a protrusion-like, preferably circumferential tapered portion or a shoulder, on which the internally arranged end of the spring 6 rests. The spring 6 here acts on the buffer 3 via this shoulder and on the latching bolt 5 via the actuating flange 53. The spring 6 provides a restoring force which acts in the direction of the center axis of the latching bolt 5. The restoring force of the spring here acts in a direction which displaces the latching bolt 5 from the release position into the blocking position. Accordingly, the latching bolt 5 is retained in the blocking position by the spring 6, and the spring 6 displaces the latching bolt 5 from the release position into the blocking position.

Figure 5:
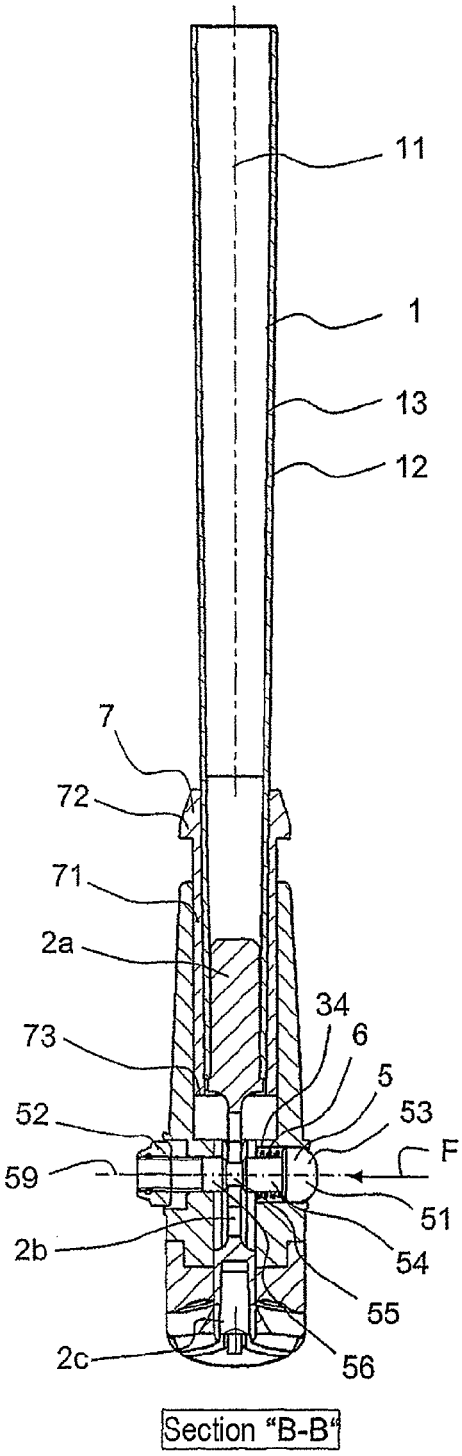
FIG. 5 shows a longitudinal section of a Nordic walking pole with a buffer in a middle position, the section being taken along section line A-A according to FIG. 1.

By virtue of an adjusting force F, which is greater than the spring force and acts counter to the same, being applied, the latching bolt 5 can be moved in the direction of its center axis 59 from the blocking position into the release position. This is shown in FIG. 5. The adjusting force F can be applied manually by the user via the actuating flange 53. If the adjusting force F is no longer applied, the buffer 3 is automatically displaced, or spring-restored, into its blocking position.

FIG. 4 illustrates the buffer 5 in its top position. Parts of the tip body 2, in particular the tip 24, project beyond the rolling surface 35 in this position. When the pole is being used, it comes into contact with the ground by way of the tip 24. The latching bolt 5 here is located in the position in which the buffer 3 is blocked. Therein, the securing portion 56 of the latching bolt 5 is located in the top widened portion 42 of the latching guide means 4. Since the diameter of the securing portion 55 is larger than the extent of the slot 41 of the latching guide means 4, axial movement of the buffer 3 is not possible.

FIG. 5 shows the latching bolt 5 in its second position. The latching bolt 5 is moved into the second position from the first position by the adjusting force F. In the second position, the release portion 55 of the latching bolt 5 is located in the latching guide means 4. In order to allow movement of the buffer, the entire release portion 55 has to be located in the slot 41 and/or the widened portion 42 of the latching guide means 4. Since the diameter of the release portion 55 is smaller than the extent of the slot 41, the buffer can be displaced along the center axis 11 of the pole. The configuration of the latching bolt 5 means that it is not possible for the latching bolt 5 to return into the first position when the buffer 3 is located between the top and the bottom end position, since the latching bolt 5 would bear laterally against the latching guide means 4 by way of the transition between the release portion 55 and securing portion 56. The device may also be described as being self-latching. The latching bolt 5 is moved actively by the user (adjusting force) from the blocking position into the release position. In the event of the buffer 3 being subsequently displaced, and of the adjusting force then being withdrawn, the latching bolt 5 moves in the direction of the blocking position. This movement is prevented, however, since the latching bolt 5 is bearing against the latching guide means 4. As soon as the buffer 3 reaches the position in which a securable position is envisaged, the movement of the latching bolt 5 from the release position into the blocking position is enabled. The latching bolt 5 moves automatically (with self-latching action), on account of the restoring force of the spring 6, from the release position into the blocking position.

Figure 6:
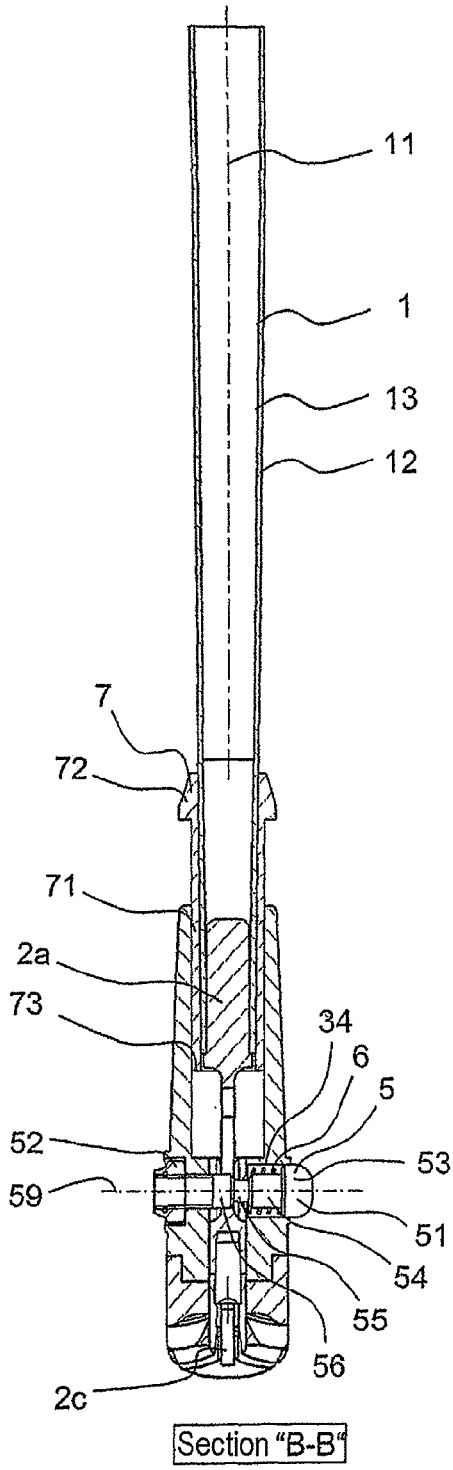
FIG. 6 shows a longitudinal section of a Nordic walking pole with a buffer in a bottom position, the section being taken along section line B-B according to FIG. 2.
Figure 7:
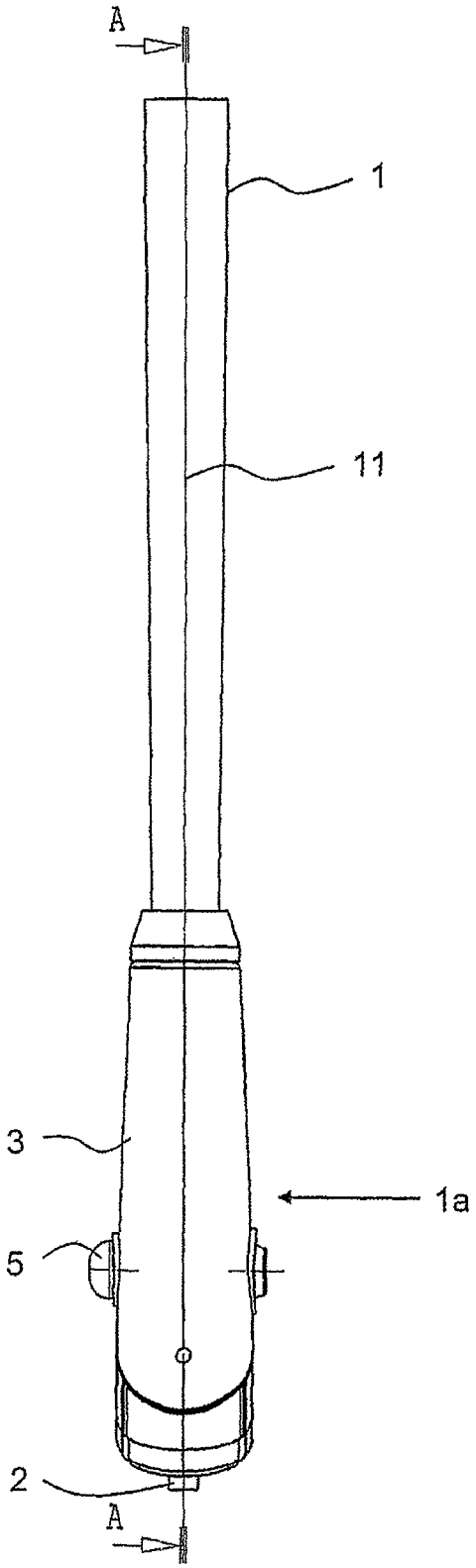
FIG. 7 shows a view of a second exemplary embodiment of a Nordic walking pole from the rear, with a buffer in a top position according to the present invention.
Figure 8:
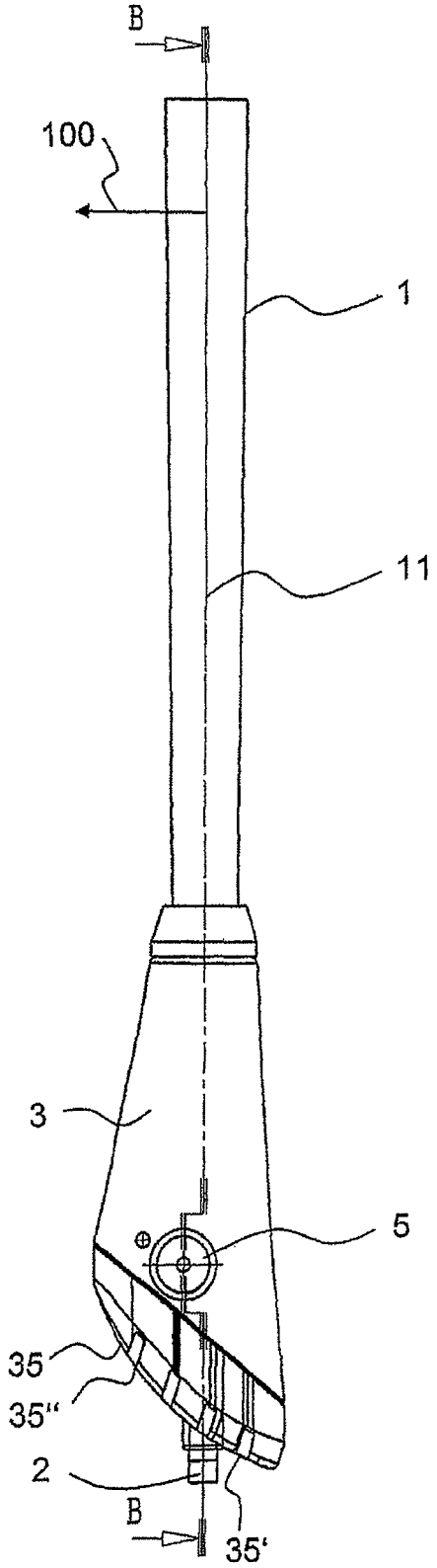
FIG. 8 shows a side view of a Nordic walking pole according to FIG. 7.

FIG. 6 shows the rubber buffer in its bottom position, in which the tip body 2 is fully enclosed by the buffer 3. In this position, there are therefore no parts of the tip 4 projecting beyond the rolling surface 35 of the buffer. The latching bolt 5 here can return into its first position again since the axis of the latching bolt 5 and the center axis of the bottom widened portion 43 are essentially collinear and the diameter of the securing portion 56 is smaller than the diameter of the bottom widened portion 43. Since the diameter of the securing portion 55 is larger than the extent of the slot 41 of the latching guide means 4, axial movement of the buffer 3 is not possible.

In order to block the buffer 3 in a position between the top position and the bottom position, further widened portions 42, 43 may be arranged in the region of the slot 41, in which case it is also possible for the latching bolt 5 to assume a blocking position when the buffer 3 is in a position other than the top position or bottom position.

FIGS. 7 to 12 show a second exemplary embodiment according to the present invention. Like elements are provided with like designations.

Figure 9:
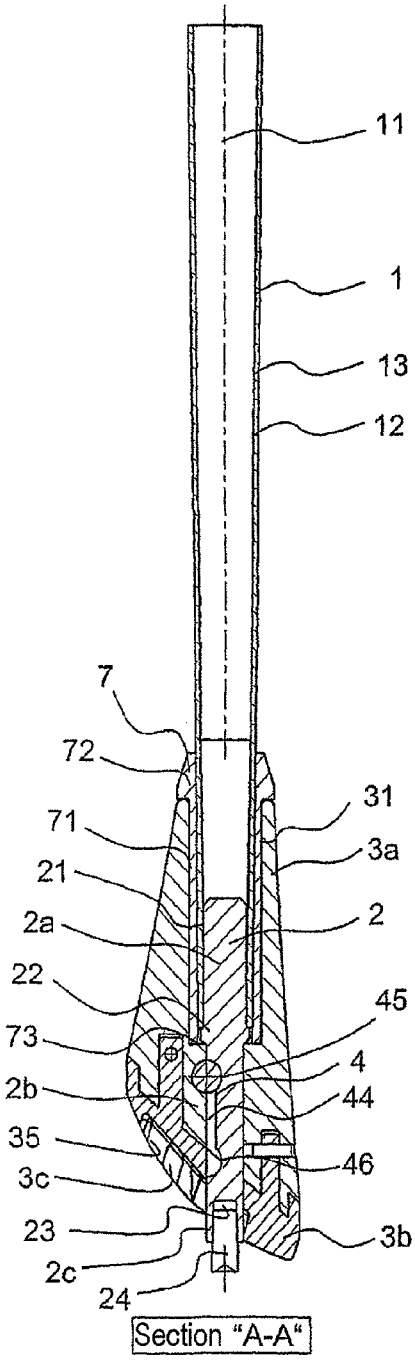
FIG. 9 shows a longitudinal section of a Nordic walking pole with a buffer in the top position, the section being taken along section line A-A according to FIG. 7.
Figure 10:
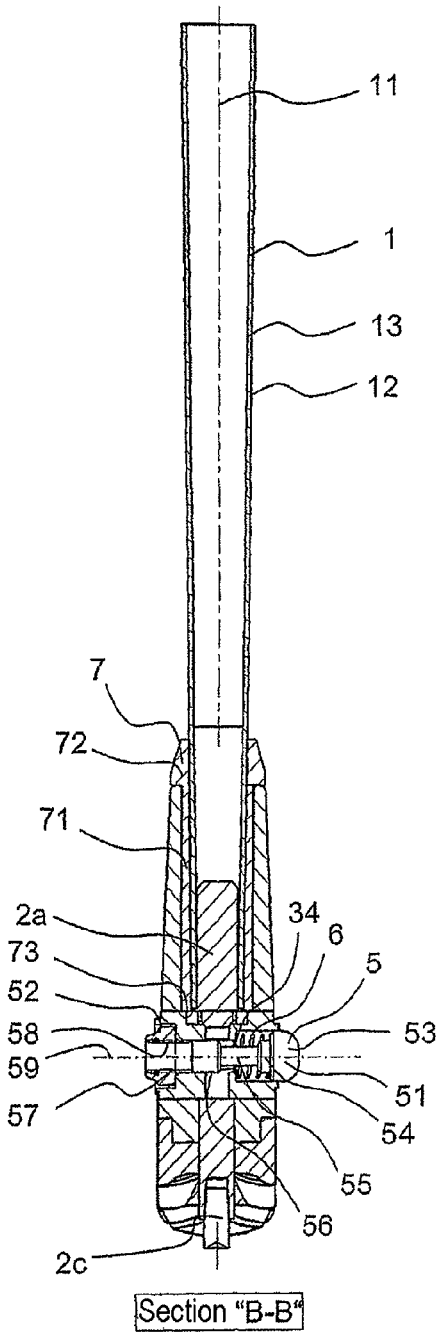
FIG. 10 shows a longitudinal section of a Nordic walking pole with a buffer in the top position, the section being taken along section line B-B according to FIG. 8.
Figure 11:
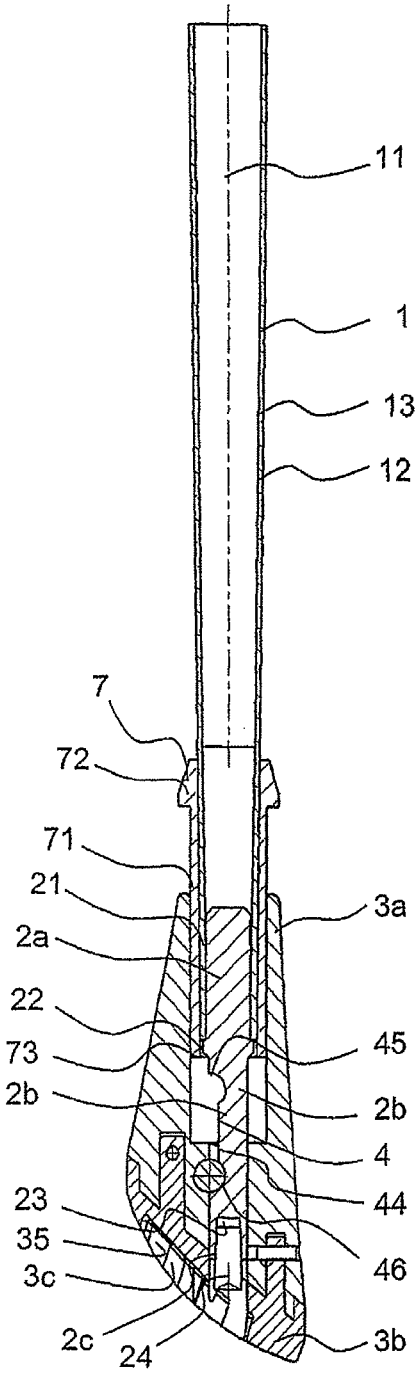
FIG. 11 shows a longitudinal section of a Nordic walking pole with a buffer in the bottom position, the section being taken along section line "A-A", which is analogous to section line A-A according to FIG. 7.
Figure 12:
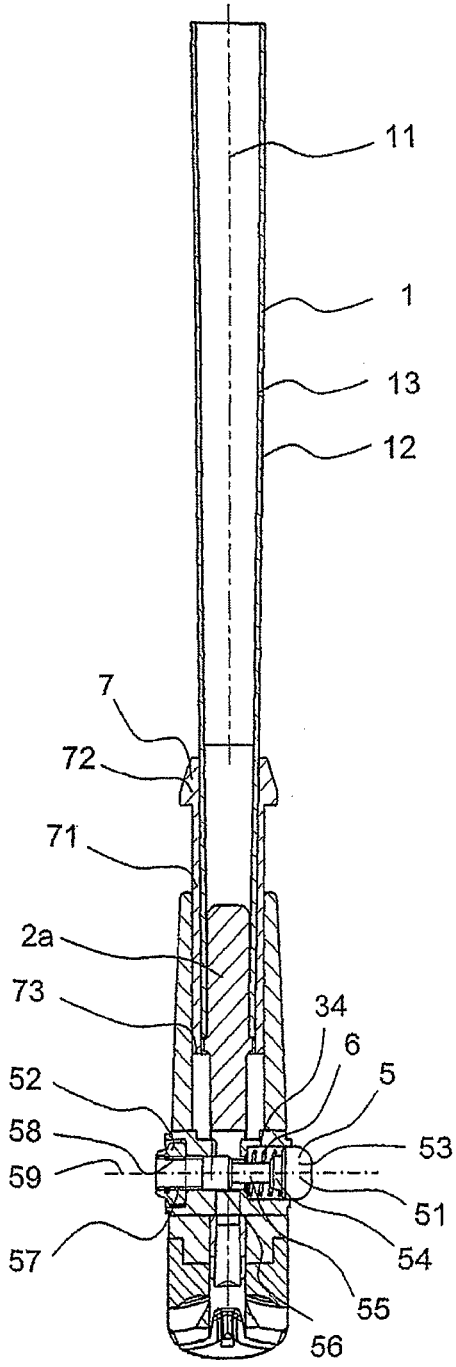
FIG. 12 shows a longitudinal section of a Nordic walking pole with a buffer in the bottom position, the section being taken along section line "B-B", which is analogous to section line B-B according to FIG. 8.
Figure 13:
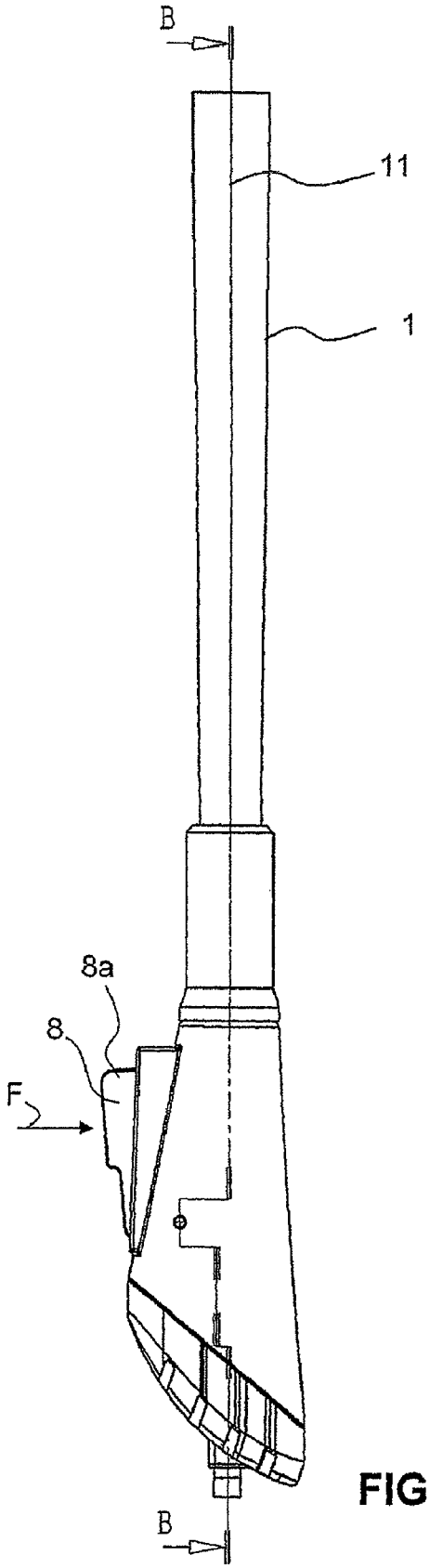
FIG. 13 shows a side view of a third exemplary embodiment of a Nordic walking pole with a buffer in a top position according to the present invention.

FIG. 9 shows the second exemplary embodiment in a sectional view. The middle portion **2*b* of the tip body 2, in this exemplary embodiment, has a circular-cylindrical cross section. The latching guide means 4 is formed on the surface of the circular-cylindrical portion. The latching guide means 4 comprises an axial depression or recess 44, a top depression 45 and a bottom depression 46. The top depression 45 and the bottom depression 46 here have, in the circular-cylindrical surface, a greater depth in the direction of the axis than does the axial depression 44**.

In other words, it may also be said that the present latching guide means is a latching guide means according to the first exemplary embodiment of which the center axis is located essentially on the surface of the tip body 2. This results in a structure which contains virtually merely half of the slots and of the two openings.

In the second exemplary embodiment, a latching bolt 5 likewise serves as the latching body. The axis of the latching bolt 5 is offset in relation to the center axis 11. This means that, rather than intersecting the center axis 11, the axis of the latching bolt 5 is arranged virtually tangentially.

The configuration of the latching bolt 5 and of the latching guide means 4 allows the two elements to interact with one another in a manner similar to the first exemplary embodiment.

FIGS. 13 to 16 show a third exemplary embodiment according to the present invention. In this third exemplary embodiment, the latching element is in the form of a latching lever 8. Like parts are provided with like designations.

The tip body 2 has a cylindrical external shape essentially in all three regions **2*a*-2*c*. In the top region 2*a*, it has a plurality of, in this case three, at least partially circumferential channels 25. In the middle region 2*b*, the tip body 2 contains the latching guide means 4. In this exemplary embodiment, the latching guide means 4 is in the form of a top recess 47 and of a bottom recess 48, which are made in the surface of the tip body 2. The bottom region 2*c*** is configured in a manner essentially identical to the first two exemplary embodiments.

The tip body 2, in this exemplary embodiment, is connected to the pole body 1 via the sleeve 7. The channels 25 here form a form-fitting connection between the sleeve 7 and pole body 1. Accordingly, such a connection is usually made by injection molding, but it is also possible to achieve this connection via adhesive bonding, screw connection or the like.

Such a connection is likewise possible in the case of the first and second exemplary embodiments. In the same way, in the third exemplary embodiment, it is also possible for a connection between the tip body 2 and pole body 1 to be configured as it is in the first and the second exemplary embodiments.

In its top region, the buffer 3 has an opening 39 which is configured in order to accommodate the latching lever 8. It is likewise the case, as in the above described exemplary embodiments, that the buffer 3 slides on the sleeve 7 from a top position into a bottom position. As has already been described above, in the top position of the buffer, parts of the tip body 2 project beyond the rolling surface 35. As soon as the buffer 3 is located in the bottom position, the tip body 2 is fully accommodated by the buffer 3 and there are no parts of the tip body 2 projecting beyond the rolling surface 35.

The configuration which will be described hereinbelow allows the latching lever 8 to be actuated by means of an actuating force which is illustrated by an arrow F and can be applied to the latching lever directly by hand.

The latching lever 8 has essentially an actuating region 8*a* and a latching region 8*b*. The actuating region 8*a* has a blind hole 81 for accommodating a restoring spring 6. The latching region 8*b* has a latching protrusion 82. The latching protrusion 82 here is located essentially perpendicularly to the latching lever 8 and can engage in corresponding openings or recesses 47, 48 in the tip body 2. It is also possible for the latching protrusion 82 to be cylindrical and to engage in cylindrical holes in the tip body. The hinge 83 is arranged between the actuating region 8*a* and the latching region 8*b*. The latching lever 8 is connected to the buffer 3 via this hinge 83, and the latching lever 8 can execute a tilting movement about this hinge 83.

The restoring spring 6 ensures that the lever is restored from the release position into the blocking position. The spring 6 is arranged between the latching lever 8 and the buffer 3.

Figure 14:
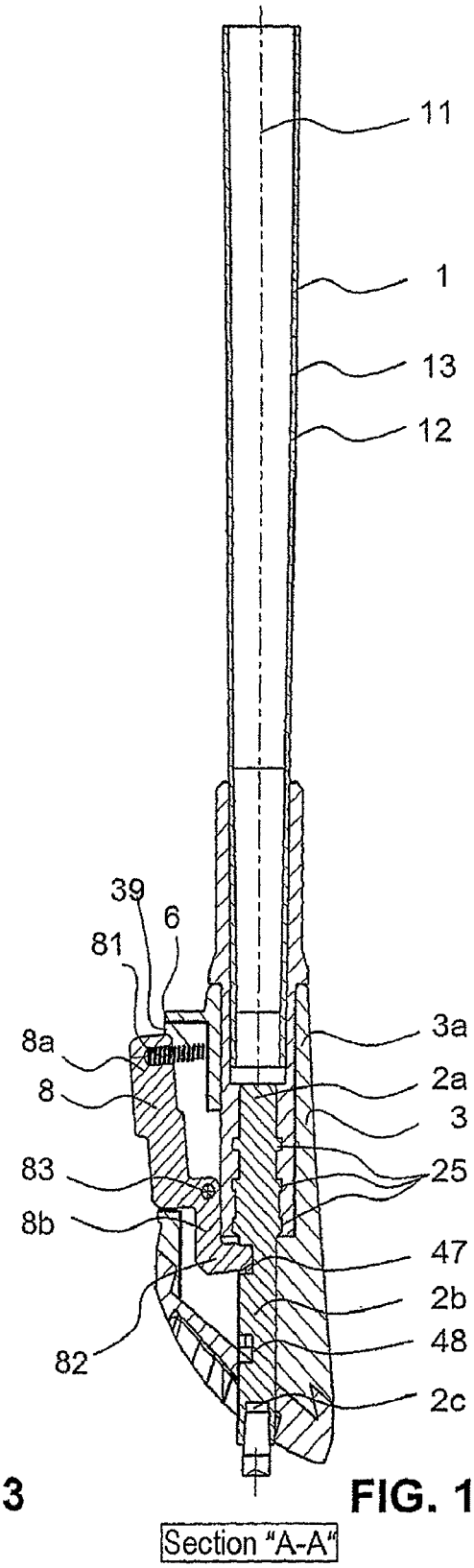
FIG. 14 shows a longitudinal section of a Nordic walking pole with a buffer in a top position according to FIG. 13.

FIG. 14 shows the latching lever 8 in its blocking position. The latching protrusion 82, in this case, projects into the top recess 44. Accordingly, the buffer 3 is in its top position here and parts of the tip body 2 project beyond the rolling surface 35 of the buffer 3.

Figure 15:
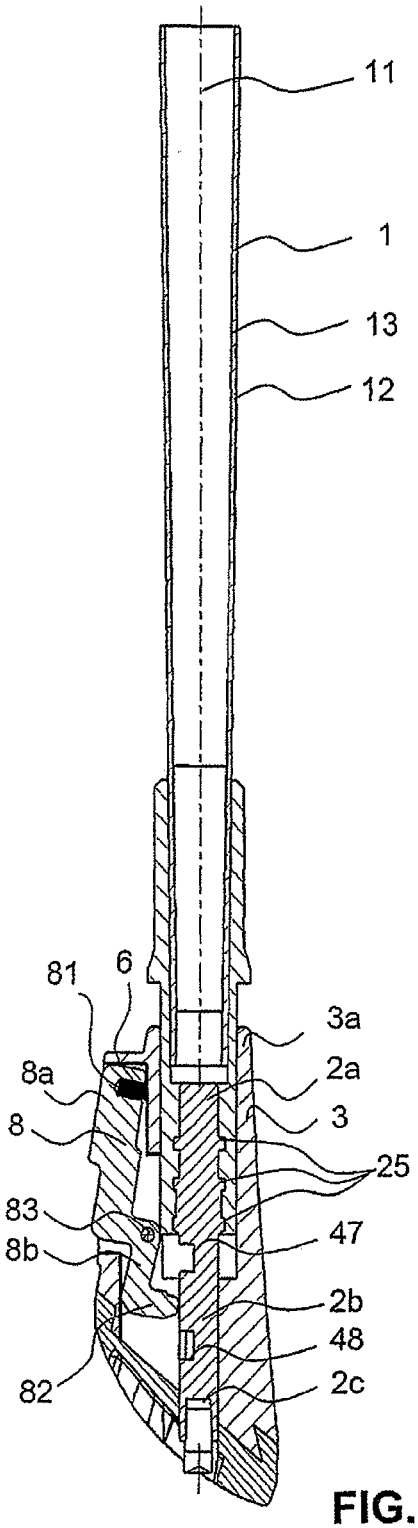
FIG. 15 shows a longitudinal section of a Nordic walking pole with a buffer according to FIG. 13 in a middle position.

FIG. 15 shows the latching lever 8 in its release position. The latching protrusion 82, in this case, neither engages with the top recess 47 nor with the bottom recess 48. The buffer 3 can be displaced freely in the axial direction here.

Figure 16:
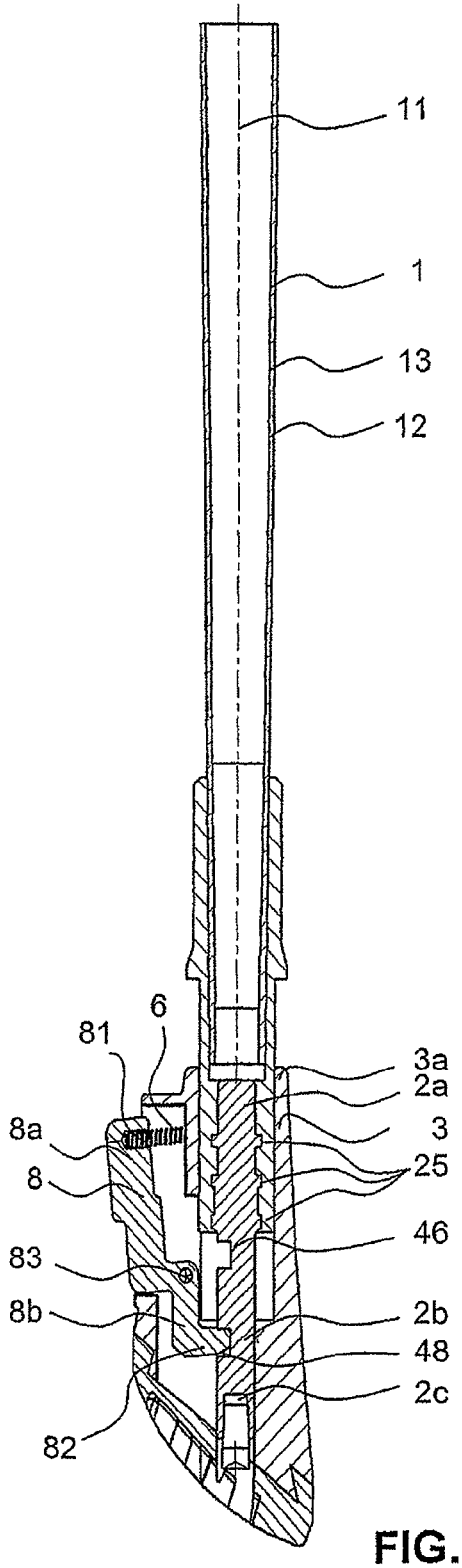
FIG. 16 shows a longitudinal section of a Nordic walking pole with a buffer according to FIG. 13 in a bottom position.
Figure 17:
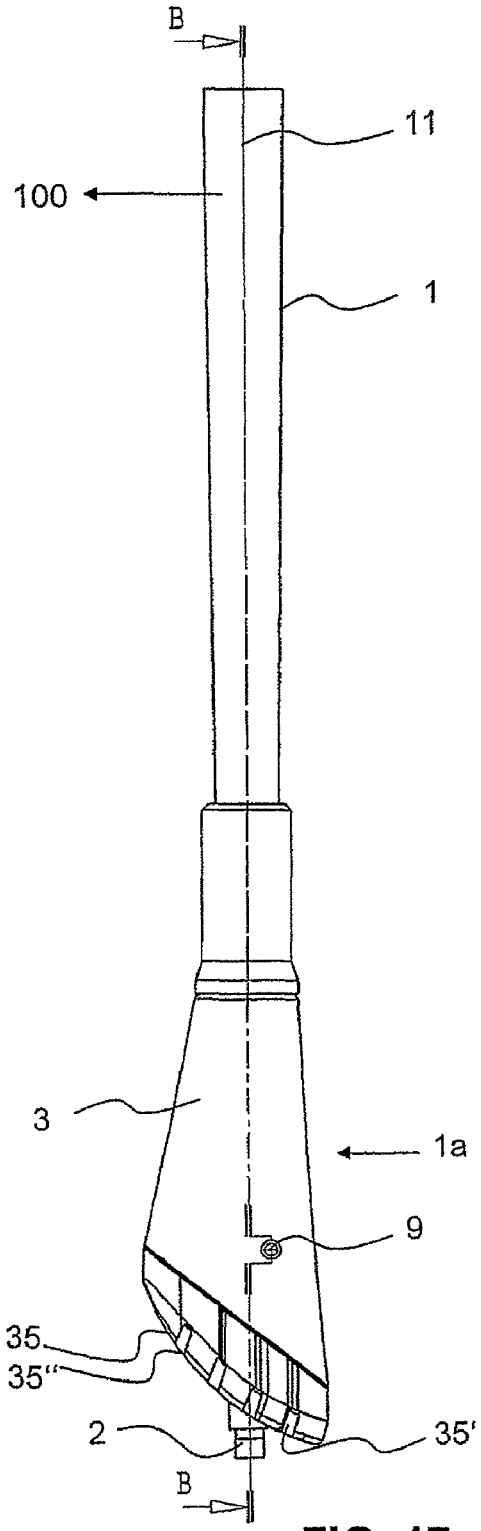
FIG. 17 shows a side view of a fourth exemplary embodiment of a Nordic walking pole with a buffer in a top position according to the present invention.

In FIG. 16, the latching lever 8, once again, assumes its blocking position. Here, the latching protrusion 82 engages in the bottom recess 48 and blocks the buffer 3 in its bottom position. The tip body 2 here is fully enclosed by the buffer.

FIGS. 17 to 21 show a fourth exemplary embodiment according to the present invention. Like parts are provided with like designations. In this fourth exemplary embodiment, the latching element is in the form of a fixed latching pin 9. The latching pin 9 here is essentially fixed to the buffer 3. The buffer 3 is connected to the pole body 1 such that the buffer 3 can be displaced axially and can be rotated about the center axis 11.

Figure 18:
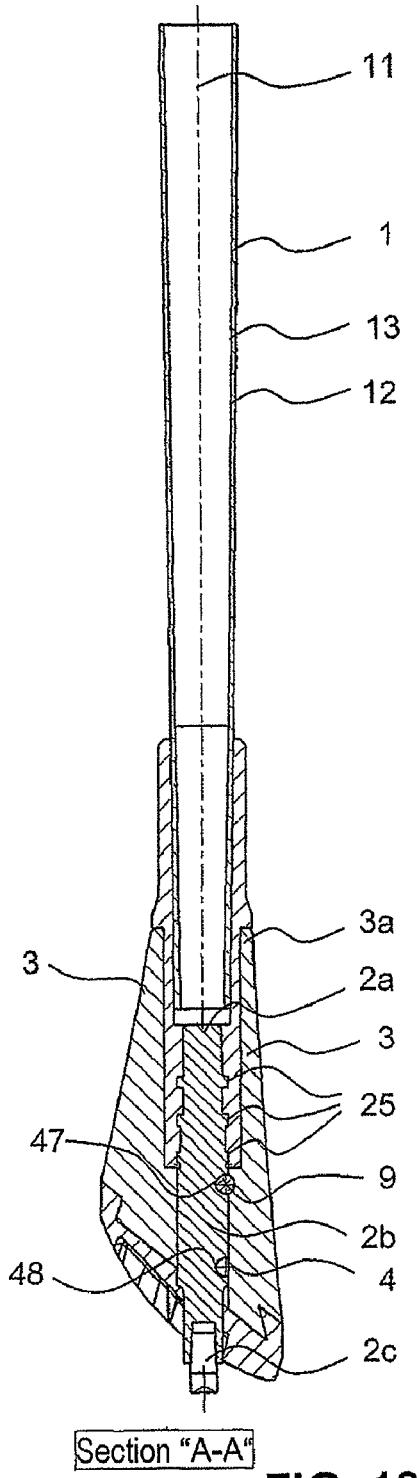
FIG. 18 shows a longitudinal section of a Nordic walking pole with a buffer in a top position according to FIG. 17.
Figure 19:
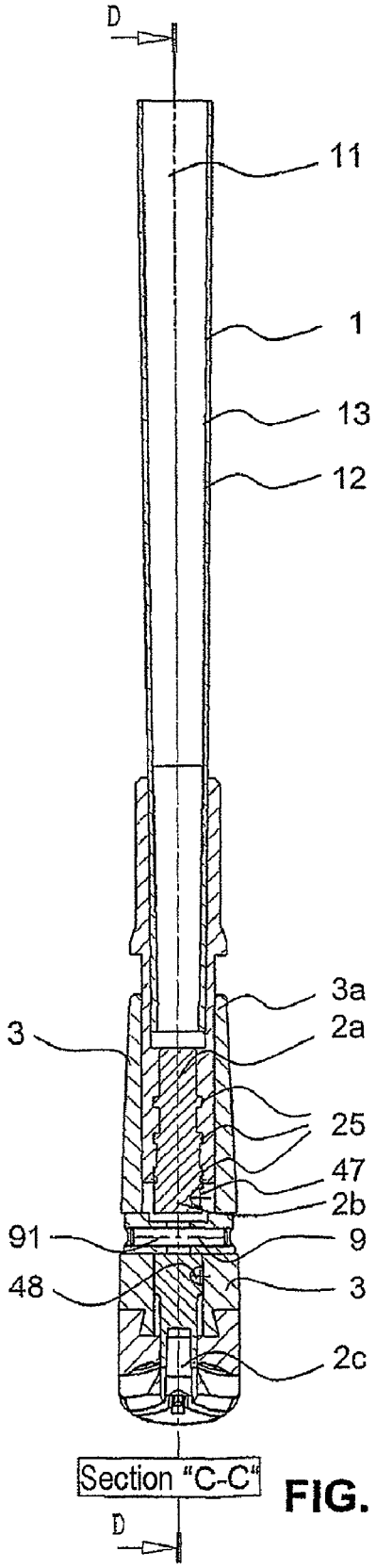
FIG. 19 shows a longitudinal section of a Nordic walking pole with a buffer according to FIG. 17 in a middle position.
Figure 20:
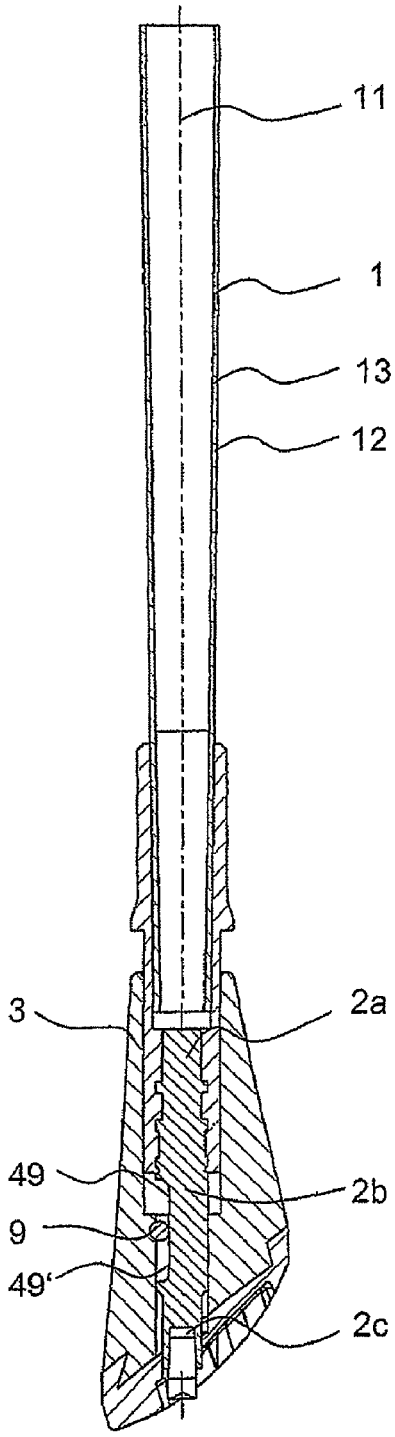
FIG. 20 shows a longitudinal section of a Nordic walking pole with a buffer according to FIG. 17 in a middle position.

FIGS. 18 to 20 show a sectional illustration of the arrangement of the latching guide means 4. In this exemplary embodiment, the latching guide means 4 comprises a top, essentially partially circumferential recess 47, a bottom, essentially partially circumferential recess 48 and an axial recess 49, which is arranged parallel to the center axis 11. The top recess 47 and the bottom recess 48 are arranged on the surface of the tip body 2, at a distance apart from one another. The recesses 47, 48 here are in the form of wholly or at least partially encircling channels. The top recess 47 is connected to the bottom recess 48 via the axial recess 49. The axial recess 49 is arranged in the surface of the tip body 2.

FIG. 18 shows the buffer 3 in its top secured position. The latching pin 9 here is located in the top recess 47. The buffer is thus connected in a form-fitting manner to the tip body 2. In the present exemplary embodiment, the buffer 3 may be secured or blocked in two positions, namely in a top position, in which the latching pin 9 ends up located in the top recess 47, and in a bottom position, in which the latching pin 9 ends up located in the bottom recess 48. FIGS. 19 and 20 show the buffer 3 in a position in which the buffer 3 can be displaced or moved axially, respectively. Rotation about the pole axis 11 allows the buffer to be moved from the secured position to the movable position. Therein, the buffer 3 has to be rotated here such that the latching pin 9 ends up to be located in the region in which the axial recess 49 intersects the top recess 47 or the bottom recess 48, respectively. As soon as the axis 91 of the latching pin is essentially parallel with the base 49' of the axial recess 49, the buffer 3 can be displaced axially. The top recess 47 and the bottom recess 48, in addition, have a stop function and thus limit the axial displaceability of the buffer 3.

In order for the buffer 3 to be secured again in the top position or in the bottom position, respectively, the buffer has to be located in the axial direction such that the latching pin 9 is level with the top recess 47 or with the bottom recess 48, respectively. The buffer 3 can then be rotated about the pole axis 11, such that the latching pin 9 can engage in a form-fitting manner in the top recess 47 or in the bottom recess 48.

Figure 21:
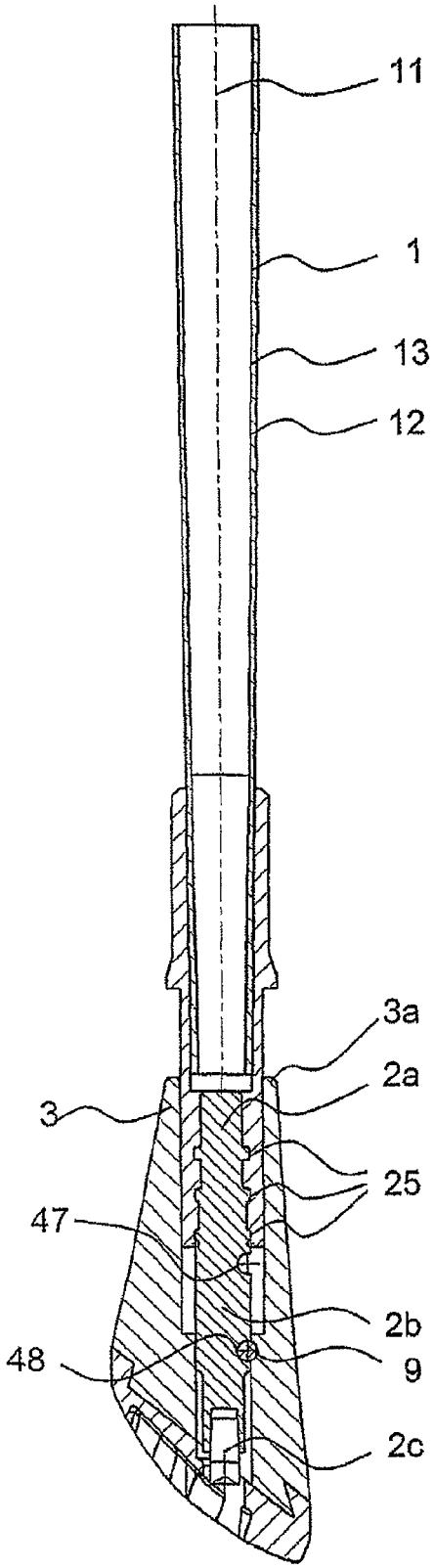
FIG. 21 shows a longitudinal section of a Nordic walking pole with a buffer according to FIG. 17 in a bottom position.

FIG. 21 shows the buffer 3 in its bottom secured position. The latching pin 9 here engages in the bottom recess 48.

LIST OF REFERENCE NUMERALS

1 Pole body
2 Tip body
2*a* Top region of 2
2*b* Middle region of 2
2*c* Bottom region of 2
3 Buffer
4 Latching guide means
5 Latching body
6 Spring
7 Sleeve
8 Latching lever
9 Latching pin
11 Center axis
12 Outer side
11 Inner side
21 External shape
22 Flange
23 Opening
24 Tip
31 Opening
32 Accommodating opening
34 Latching opening
35 Rolling surface
41 Slot
42 Top widened portion; opening
43 Bottom widened portion; opening
44 Depression/recess
45 Top depression

46 Bottom depression
47 Top recess
48 Bottom recess
49 Axial recess
51 Latching-bolt pin
52 Latching-bolt disk
53 Actuating flange
54 Spring portion
55 Release portion
56 Securing portion
57 Fastening portion
58 Opening
59 Center axis
71 Tubular cross-sectional shape
72 Flange
73 Bottom end
81 Blind hole for restoring spring
82 Latching protrusion
83 hinge
100 Direction of travel

The invention claimed is:

1. A pole, having a pole body with a tip body and a buffer provided at its bottom end, wherein at least one of the tip body or the lowermost portion of the pole body is arranged to pass through a central opening in the buffer, and wherein the buffer is mounted such that it is configured to be displaced and secured in an axial direction in relation to the pole body in the central opening, wherein the buffer is configured to be secured in at least two axially different positions in relation to the pole body via a form-fitting connection, and wherein the tip body has on its surface a latching guide means in which a latching body mounted in the buffer is configured to engage in a form-fitting manner in order to secure the axial position.

2. The pole as claimed in claim 1, wherein the latching body is mounted in a pivotable or displaceable or fixed manner in the buffer.

3. The pole as claimed in claim 1, wherein the latching body can be moved from a first position, in which the buffer is blocked in a form-fitting manner in respect of movement relative to the pole body, into a second position, in which the buffer can be displaced axially relative to the pole body.

4. The pole as claimed in claim 1, wherein an elastic restoring element is provided, which applies force to the latching body.

5. The pole as claimed in claim 4, wherein the restoring element brings about a self-latching return of the latching body from a position in which the buffer is displaceable into a position in which the buffer is blocked.

6. The pole as claimed in claim 4, wherein the elastic restoring element is provided in the form of a helical spring.

7. The pole as claimed in claim 1, wherein the latching body is a latching bolt which is located preferably essentially at right angles to the center axis of the pole body.

8. The pole as claimed in claim 7, wherein the latching guide means is a slot which is arranged in the tip body and runs along the center axis of the pole body, wherein a first, top widened portion is arranged at a first end of the slot and a second, bottom widened portion is arranged at the second end of the slot and further widened portions are provided therebetween, and wherein the latching bolt is arranged to pass or engage through the slot or the widened portions, respectively.

9. The pole as claimed in claim 8, wherein the widened portions are designed as cylindrical through-openings with a diameter which is greater than the width of the slot.

10. The pole as claimed in claim 7, wherein the latching guide means is recess which is arranged on the surface of the tip body and runs along the center axis of the pole body, wherein a first, top depression is arranged at the first end of the recess and a second, bottom depression is arranged at the second end of the recess.

11. The pole as claimed in claim 1, wherein the latching body is in the form of a lever articulated on the buffer.

12. The pole as claimed in claim 11, wherein the latching guide means comprises a top recess and a bottom recess, both of which are arranged on the surface of the tip body, it being possible for parts of the lever to engage in a form-fitting manner in these recesses.

13. The pole as claimed in claim 11, wherein the latching lever has essentially an actuating region and a latching region.

14. The pole as claimed in claim 13, wherein the actuating region has a blind hole for accommodating a restoring spring.

15. The pole as claimed in claim 1, wherein the latching body is configured as a latching pin which is fixed to the buffer.

16. The pole as claimed in claim 15, wherein the latching guide means comprises a top, at least partially encircling recess, which is arranged on the surface of the tip body, a bottom, at least partially encircling recess and an axial recess, which axial recess connects the top recess and the bottom recess, wherein, in a first, securing rotary position of the buffer in relation to the pole, parts of the latching pin can engage in a form-fitting manner in the top or the bottom recess, such that the buffer is secured, and wherein, in a second, displaceable rotary position of the buffer in relation to the pole, parts of the latching pin engage in the axial recess, such that the buffer can be moved axially.

17. The pole as claimed in claim 1, wherein it has arranged on its underside an exchangeable region, which forms the rolling surface, wherein the region can be fitted on the top portion of the buffer via force-fitting or form-fitting connecting means.

18. The pole as claimed in claim 17, wherein the exchangeable region is a profile region.

19. The pole as claimed in claim 17, wherein the exchangeable region consists of a material which is suitable, in respect of friction, for rolling.

20. The pole as claimed in claim 1, wherein it has arranged on its underside an exchangeable region, which forms the rolling surface, wherein the region can be fitted on the top portion of the buffer via force-fitting or form-fitting connecting means.

21. The pole as claimed in claim 20, wherein the exchangeable region is a profile region.

22. The pole as claimed in claim 20, wherein the exchangeable region consists of a material which is suitable, in respect of friction, for rolling.

* * * * *